United States Patent [19]

Takahashi et al.

[11] 4,436,514

[45] Mar. 13, 1984

[54] EXHAUST MEANS FOR MARINE PROPULSION UNIT

[75] Inventors: Masanori Takahashi, Hamamatsu; Hidehiko Uehara, Shizuoka, both of Japan

[73] Assignee: Yamaha Hatsudoki Kabushiki Kaisha, Iwata, Japan

[21] Appl. No.: 302,372

[22] Filed: Sep. 15, 1981

[30] Foreign Application Priority Data

Sep. 16, 1980 [JP] Japan ..... 55-128377

[51] Int. Cl.[3] ..... B63H 1/14

[52] U.S. Cl. ..... 440/89; 440/900; 416/93 A

[58] Field of Search ..... 440/78, 83, 89, 900; 416/93, 93 A, 93 M

[56] References Cited

U.S. PATENT DOCUMENTS

| | | | |
|---|---|---|---|
| 1,252,360 | 1/1918 | Moore | 440/89 |
| 2,213,609 | 9/1940 | Ronning | 440/89 |
| 3,356,151 | 12/1967 | Strang | 440/89 |
| 3,623,447 | 11/1971 | Jacobson | 440/89 |
| 3,754,837 | 8/1973 | Shimanckas | 416/93 A |
| 3,788,267 | 1/1974 | Strong | 440/89 |
| 3,871,324 | 3/1975 | Snyder | 440/89 |
| 4,317,655 | 3/1982 | Schiek | 440/78 |

FOREIGN PATENT DOCUMENTS

| | | | |
|---|---|---|---|
| 54-133981 | 4/1979 | Japan | 440/89 |

*Primary Examiner*—Trygve M. Blix
*Assistant Examiner*—Stephen P. Avila
*Attorney, Agent, or Firm*—Kerkam, Stowell, Kondracki & Clarke

[57] ABSTRACT

Marine propulsion unit having a propeller assembly formed with exhaust gas passages through the propeller hub. An outer pipe is provided to encircle the propeller hub with a radial spacing and has a rear end extending beyond the rear end of the hub. The rear end of the exhaust gas is decreased in diameter at the rear end portion thereof so that the rear end opening of the outer pipe is smaller in diameter than the propeller hub so that the exhaust gas is forced to flow, during a reverse movement, from the exhaust gas passage in the hub to the space between the hub and the outer pipe. For facilitating manufacture of the outer pipe through conventional casting technique, the outer pipe is comprised of a front and rear parts which are mated together.

5 Claims, 9 Drawing Figures

EXHAUST MEANS FOR MARINE PROPULSION UNIT

The present invention relates to marine propulsion units such as outboard propulsion units and stern drive units and more particularly to exhaust means therefor.

It is a common practice from the viewpoint of suppressing exhaust noise to discharge engine exhaust gas of an outboard marine propulsion unit into water. It has also been known in inboard units or stern drive units to discharge engine exhaust gas into water. For the purpose, it has been known to provide exhaust passage means in and along propeller hub means so that the engine exhaust gas is discharged through an exhaust opening provided at the rear end of the propeller hub means. In this arrangement, however, problems have been encountered in that during a reverse or rearward movement the exhaust gas discharged from the exhaust opening is mixed in bubble form with water stream which is being passed through the propeller. Such bubbles of exhaust gas cause a significant decrease in the thrust of the propulsion unit and moreover produce rough or unstable engine operation due to changes in load on the propeller. Sometimes, such bubbles may cause a racing of the propeller so that the engine speed may exceed an allowable limit and damages may be produced in the engine and/or bearings.

In the U.S. Pat. No. 3,754,837 issued on Aug. 28, 1973 to William J. Shimankas discloses a propulsion unit in which the aforementioned problems may substantially be eliminated. In the arrangement as proposed by the patent, the propeller has an outer and inner hubs which are radially spaced apart so as to provide exhaust gas passageways. The propeller is mounted on a propeller shaft for axial sliding movement within a certain limit and, in forward movement, the propeller is slidably moved axially forwardly on the propeller shaft until the forward end of the outer hub abuts the lower portion of the unit so that the exhaust gas passageways in the propeller are communicated with exhaust gas passage means in the unit housing. Thus, the exhaust gas is discharged through the passageways in the propeller in the rearward direction.

In reverse movement, however, the propeller is displaced axially along the propeller shaft in rearward direction under its own thrust so that the forward end of the outer hub is moved apart from the lower portion of the unit. Thus the exhaust passage means in the unit housing is opened to the surrounding water through a space between the outer propeller hub and the unit housing. The exhaust gas is therefore discharged in front of the propeller or to the downstream side of the propeller as seen in the direction of movement.

The arrangement may be effective in eliminating or at least decreasing the problems of thrust decrease caused by the exhaust gas bubbles passing through the propeller in reverse movement. However, in order for accomplishing the desired result, complicated mechanisms are required because the propeller is necessarily mounted on the propeller shaft for axial movement.

In order for solving the above problems, a proposal has been made by the U.S. patent application Ser. No. 947,634 filed on Oct. 2, 1978 now U.S. Pat. No. 4,276,036. According to the proposal, the hub of the propeller assembly is provided with an outer pipe which is radially spaced apart from the hub body to surround at least the rear portion thereof and extend rearwardly beyond the rear end of the exhaust passage formed in the hub. The front end of the outer pipe is located forwardly of the trailing edge of the propeller blades so that in reverse operation the exhaust gas is passed through the space between the outer pipe and the hub body.

The proposed structure has been found effective to decrease the problems in the reverse movement, however, since the outer pipe is simply opened at the rear end, there still is a certain possibility that the exhaust gas is mixed with water stream which is being passed through the propeller.

The U.S. patent application Ser. No. 265,057 filed on May 19, 1981 claiming the priority based on Japanese patent application No. 55-67494 filed on May 20, 1980 therefore proposes to form the outer pipe with a rear end portion which is reduced in diameter and formed with an opening smaller in diameter than the rear end of the hub. According to the proposed arrangement, the engine exhaust gas is restricted in reverse movement to flow out of the outer pipe through the rear end opening but forced to pass through the space between the outer pipe and the hub.

The proposed arrangement is thus effective to eliminate the aforementioned problems, however, there are inconveniences in manufacture due to the special configuration of the outer pipe. For example, when the propeller and the hub are integrally moulded with the outer pipe, the moulded part can be taken out from the dies only in one direction because the rear end portion is reduced in diameter. The configuration of the space between the outer pipe and the hub must be determined so that the moulded part can readily be taken out of the dies. Thus, the moulded part may become unnecessarily thick with the result that the exhaust gas passage arears are undesirably decreased. Otherwise, it will become necessary to use an increased number of moulding cores for making it possible to mould complicated passage configurations.

It is therefore an object of the present invention to provide a further improved exhaust means for a marine propulsion unit.

Another object of the present invention is to provide exhaust means for a marine propulsion unit in which the aforementioned problems in conventional structures have substantially been eliminated.

A further object of the present invention is to provide exhaust means for a marine propulsion unit which can readily be manufactured by moulding technique.

According to the present invention, the above and other objects can be accomplished by a marine propulsion unit comprising housing means which is formed with engine exhaust gas passage means and has a lower portion supporting propeller shaft means, propeller means mounted on said propeller shaft means and including hub means and blade means, said hub means being formed with exhaust passage means which is extending axially along the hub means and connected at one end with said exhaust gas passage means in the housing means, the other end of the exhaust passage means being opened rearwardly of the hub means, outer pipe means having a portion radially spaced apart from said hub means and extending substantially parallel with said hub portion to surround at least the rear portion of said hub means, said outer pipe means extending rearwardly beyond said other end of the exhaust passage means in the hub means and having a rear end which is reduced in diameter and formed with opening means which is smaller in diameter than the rear end of said hub means, said outer pipe means having a front end which is located forwardly of trailing edge of said blade means, said outer pipe means comprising an axially front part and an axially rear part which are mated together.

The front and rear parts of the outer pipe may be connected by screw threads or any other appropriate means. The front part may be substantially cylindrical whereas the rear part may have a substantially cup shaped configuration. The rear part may be made of a casted metallic material. Alternately, it may be made of a plastic material. In an alternative arrangement, the front and rear parts of the outer pipe may be fitted together and the rear part may be connected to the propeller shaft to be supported thereby.

The above and other objects and features of the present invention will become apparent from the following descriptions of preferred embodiments taking reference to the accompanying drawings, in which.

Figure 1:
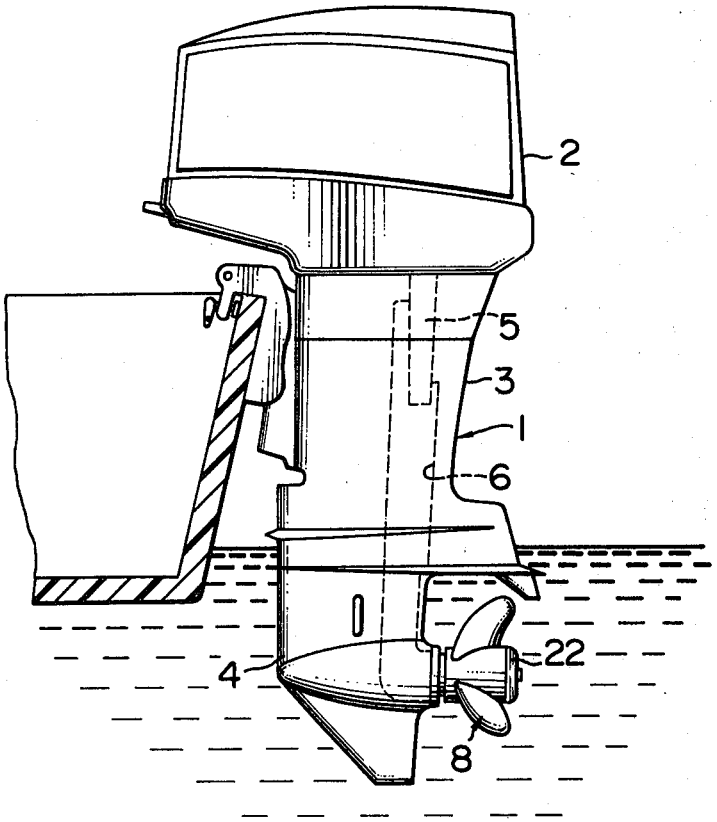
FIG. 1 is a side elevational view of an outboard marine propulsion unit embodying the feature of the present invention.

Referring now to the drawings, the outboard marine propulsion unit shown therein by a reference character 1 includes an engine cowling 2, an upper casing 3, a lower casing 4, and a propeller assembly 8D mounted on the lower casing 4. As well known in the art, an internal combustion engine is mounted on the upper casing 3 and has an exhaust pipe 5 extending downwardly in the upper casing 3 at the rear portion thereof. The housing constituted constituted by the upper and lower casings 3 and 4 is formed with an exhaust gas passage 6 which leads to an opening **6*a* provided at the rear and lower portion of the lower casing 4**.

Figure 2:
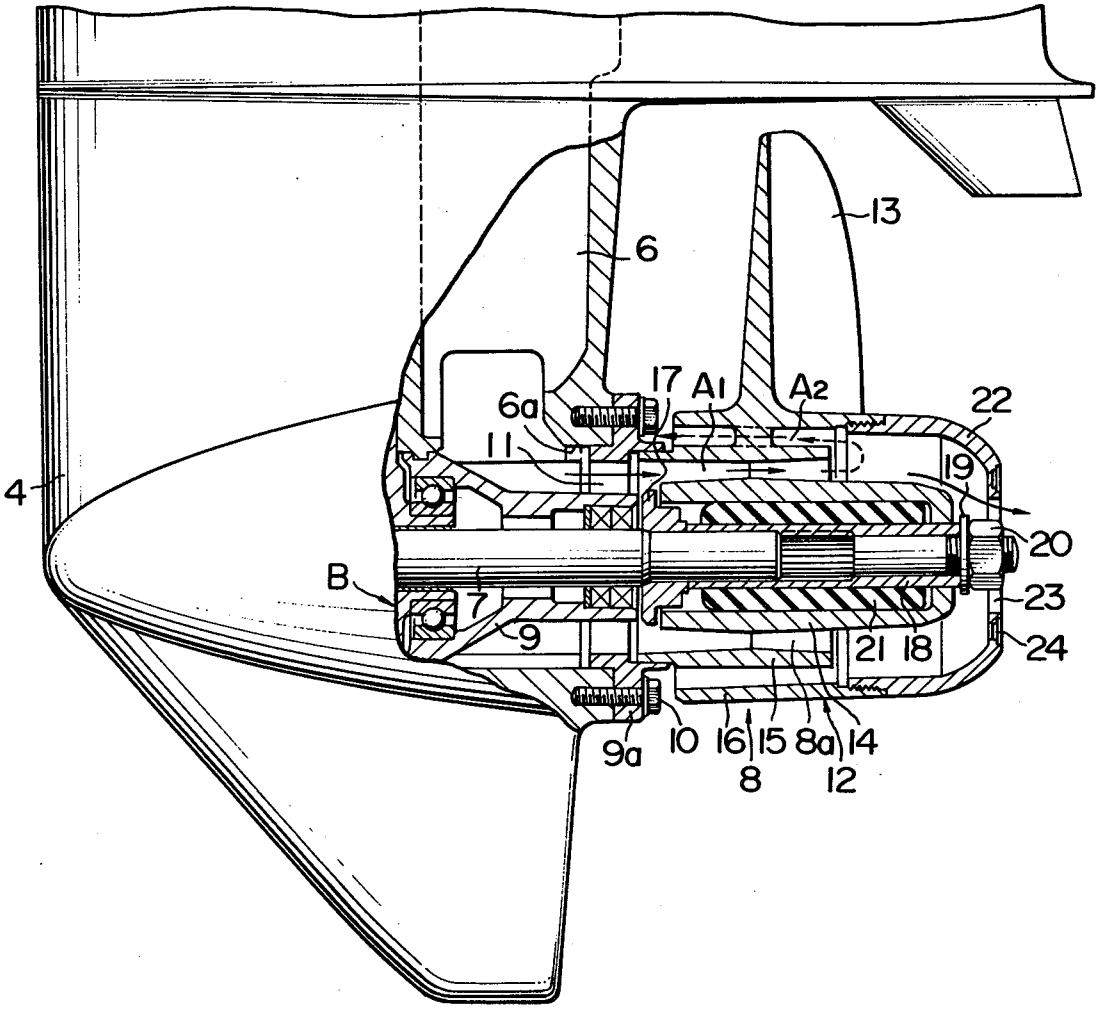
FIG. 2 is a sectional view specifically showing the propeller assembly in the propulsion unit.
Figure 3:
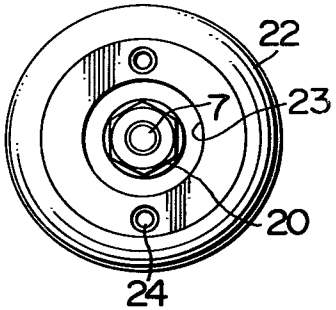
FIG. 3 is a rear end view of the propeller assembly shown in FIG. 2.

A propeller shaft 7 extends at the lower portion of the casing 4 rearwardly through the opening **6*a*. Although not shown in the drawings, the propeller shaft 7 is driven by the engine through a vertically extending drive shaft. As shown in FIG. 2, the propeller shaft 7 is supported rotatably by means of a bearing assembly B and has a rear end portion extending beyond the opening 6*a*. The bearing assembly B has a housing 9 which has an end flange 9*a* attached by means of bolts to the lower casing 4 at the opening 6*a*** thereof.

On the rear end portion of the propeller shaft 7, there is mounted the aforementioned propeller assembly 8D which comprises a hub section 12 including an inner hub 14 and an outer hub 15 which are integrally formed through radial walls **8*a* but radially spaced to define axially extending exhaust passages $A_1$. The outer hub 15 is fitted at the front end rotatably to the housing 9 of the bearing assembly B. The inner hub 14 is mounted on the rear end portion of the propeller shaft 7 through a sleeve 18 and a cushioning member 21. At the front and rear ends of the sleeve 18, there are mounted on the propeller shaft 7 a front and rear retaining rings 17 and 19, and a nut 29 is threaded into the rear end of the propeller shaft 7** to secure the propeller assembly in position.

The housing 9 of the bearing assembly B is formed with suitable number of apertures 11 which connect the exhaust passage 6 in the unit housing with the exhaust passages $A_1$ between the inner and outer propeller hubs 14 and 15. The propeller assembly includes a front outer pipe 16 which encircles and is integrally formed with the outer hub 15 through radial wall **16*a*. Thus, passages $A_2$ are formed between the outer hub 15 and the pipe 16. Propeller blades 13 are integrally formed with the front outer pipe 16** in this embodiment.

As shown in FIG. 2, the outer pipe 16 has a front end terminating at a portion forwardly of the propeller blades 13 and a rear end portion extending beyond the rear end of the outer hub 15. In the illustrated embodiment, the rear end portion of the front outer pipe 16 is formed with female screw threads. To the rear end of the front outer pipe 16, there is attached a rear outer pipe or a rear cap 22 which is decreased in diameter toward the rear end and forward with a rear end wall having a circular opening 23 of which diameter is smaller than that of the inner hub 14. The rear cap 22 is formed at the front end with male screw threads which are adapted to be engaged with the female screw threads on the front outer pipe 16. The rear cap 22 is formed on the end wall with tool receiving recesses 24 so that it can be driven by a tool into engagement with the front outer pipe 16.

In the arrangement described above, when the propeller is driven in reverse direction for performing a reverse movement, the exhaust gas from the engine is discharged through the passages 6 and $A_1$ into the rear cap 22. At this moment, however, since there is the end wall of the outer pipe cap 22, the exhaust gas is prevented to flow out of the end cap 22. In addition, water flow coming through the opening 23 into the end cap 22 serves to prevent the exhaust gas from flowing out of the end pipe 22 through the opening 23. Thus, the exhaust gas is forced to flow through the passages $A_2$. Thus, it is possible to prevent the exhaust gas bubbles passing along the propeller blades 13.

In the illustrated structure, the front outer pipe 16 can be of a relatively simple configuration so that it can be readily manufactured by a conventional casting technique.

Figure 4:
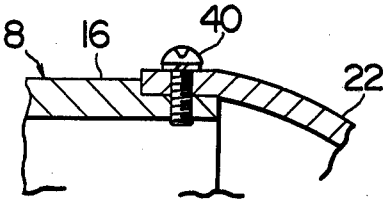
FIG. 4 is an enlarged fragmentary sectional view showing an alternative structure for connecting the front and rear parts of the outer pipe.

FIG. 4 shows an alternative structure for connecting the rear cap 22 with the front outer pipe 16. In this arrangement, the rear cap 22 is fitted at the front end to the rear end of the front outer pipe 16 and secured thereto by means of screws 40.

Figure 5:
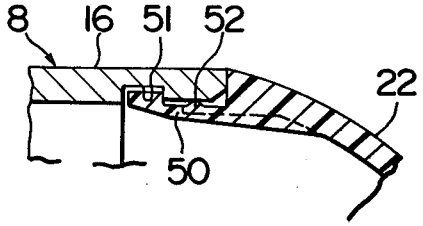
FIG. 5 is a further alternative structure for connecting the front and rear parts of the outer pipe.
Figure 6:
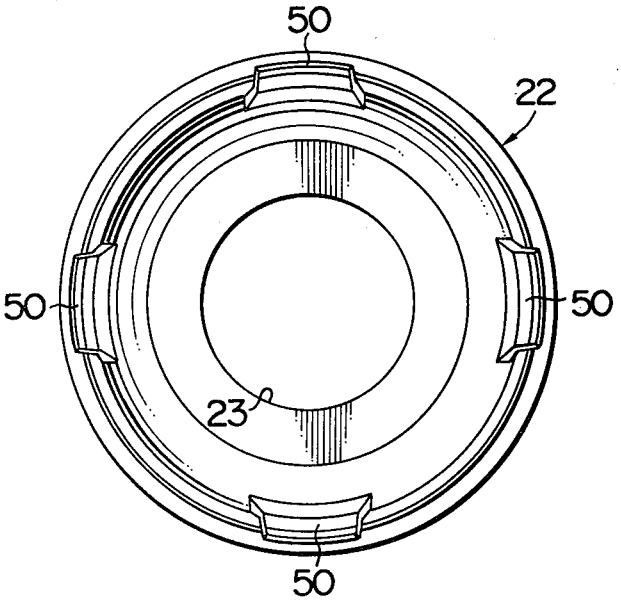
FIG. 6 is an inside view of the rear part used in the structure in FIG. 5.
Figure 7:
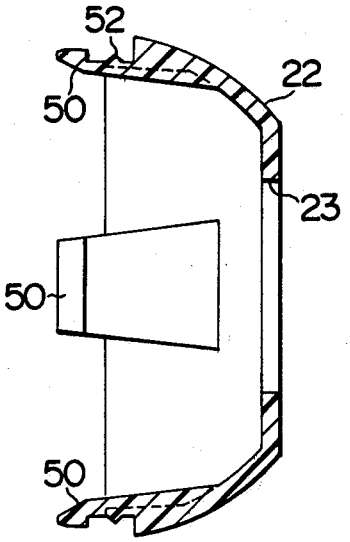
FIG. 7 is a sectional view of the rear part shown in FIG. 6.

Referring to FIGS. 5 through 7, there is shown an example of the rear cap 22 which is made of a plastic material. The rear cap 22 is formed at the front end with a plurality of retaining claws 50. The front outer pipe 16 is formed with a groove 51 for engagement with the claws 50. In the claws 50, there may be formed ridges 52 which are adapted to be engaged with the inner surface of the front outer pipe 16 to provide a gas seal.

Figure 8:
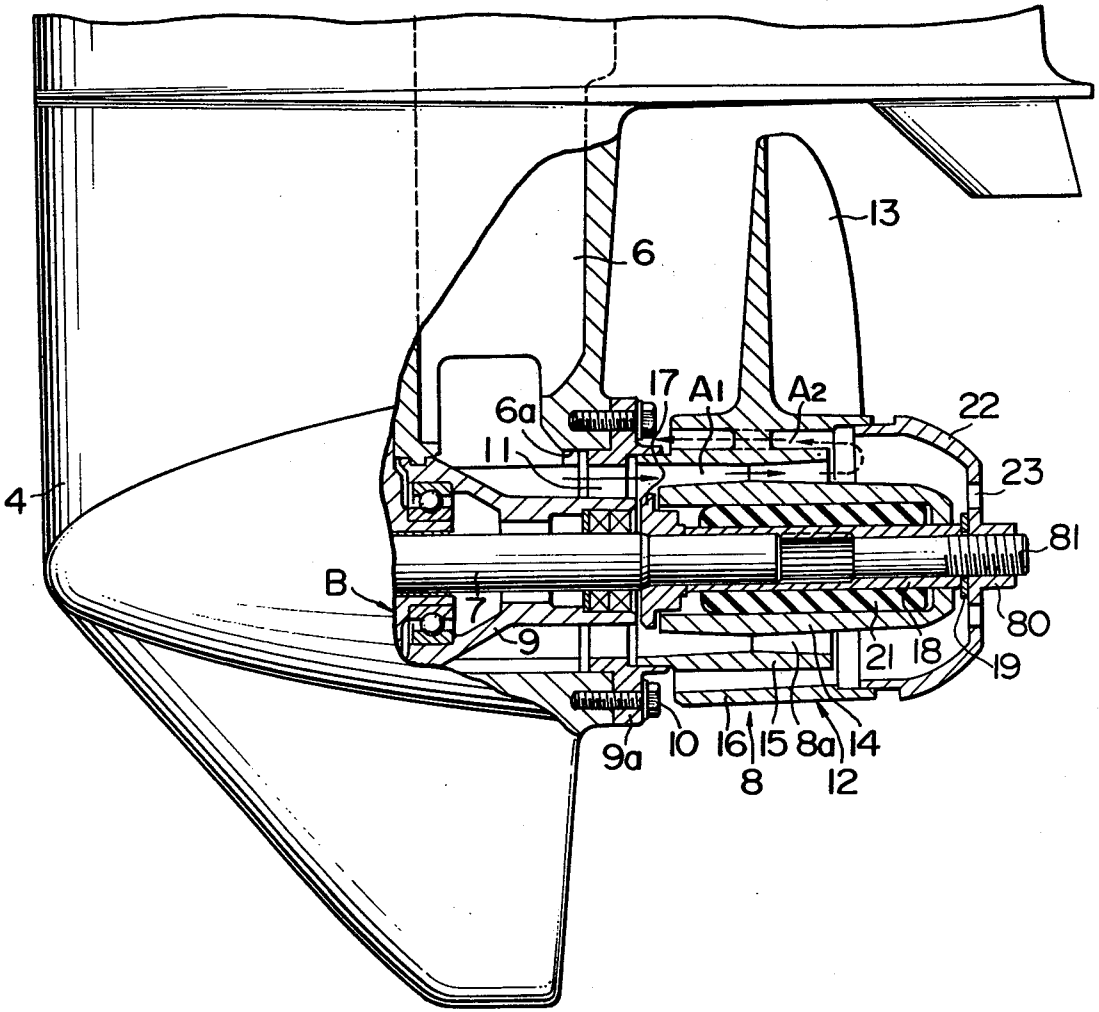
FIG. 8 is a sectional view of the propeller assembly similar to FIG. 2 but showing a further embodiment of the present invention; and, FIG. 9 is a rear end view of the hub portion of the propeller assembly shown in FIG. 8.
Figure 9:
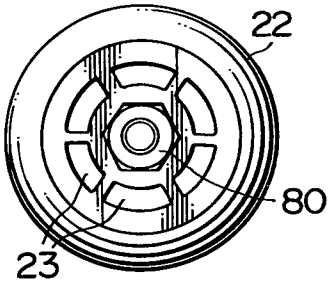

In the embodiment shown in FIGS. 8 and 9, the rear cap 22 is formed at the center of the rear end wall with an internally threaded nut portion 80. The propeller shaft 7 has an externally threaded portion 81 for engagement with the nut portion 80 on the rear cap 22 to support the same. The front end of the rear cap 22 is fitted to the rear end of the front outer pipe 16.

The invention has thus been shown and described with reference to specific embodiment, however, it should be noted that the invention is in no way limited to the details of the illustrated structures but changes and modifications may be made within the scope of the appended claims.

We claim:

1. A marine propulsion unit comprising housing means which is formed with engine exhaust gas passage means and has a lower portion supporting propeller shaft means, propeller means mounted on said propeller shaft means and including hub means and blade means, said hub means being formed with exhaust passage means which is extending axially along the hub means and connected at one end with said exhaust gas passage means in the housing means, the other end of the exhaust passage means being opened rearwardly of the hub means, outer pipe means having a front portion radially spaced apart from and integral with said hub means and extending substantially parallel with said hub means to surround at least the rear portion of said hub means to thereby form a substantially straight passage between the front portion of the outer pipe means and the hub means, said outer pipe means further having a rear portion fitted to a rear end of the front portion and means extending rearwardly beyond said other end of the exhaust passage means in the hub means, said rear portion of the outer pipe means having a rear wall formed with opening means which is smaller in diameter than the rear end of said hub means, said rear wall of the rear portion of the outer pipe means having an internally threaded central hole which is in threadable engagement with an externally threaded rear end portion of said propeller shaft means, and said outer pipe means having a front end which is located forwardly of trailing edge of said blade means.

2. A marine propulsion unit in accordance with claim 1 in which the rear part is threadably engaged with the front part.

3. A marine propulsion unit in accordance with claim 1 in which the rear part is secured to the front part by means of screw bolts.

4. A marine propulsion unit in accordance with claim 1 in which the rear part is made of a resilient plastic material and connected with the front part through resilient claw means formed on the rear part.

5. A marine propulsion unit in accordance with claim 1 in which said rear part is supported by said propeller shaft means.

* * * * *